US008348496B2

(12) United States Patent
Gritti et al.

(10) Patent No.: US 8,348,496 B2
(45) Date of Patent: Jan. 8, 2013

(54) MAINSPRING

(75) Inventors: Dominique Gritti, Cortaillod (CH); Thomas Gyger, Le Fuet (CH); Vincent Von Niederhausern, Courrendlin (CH)

(73) Assignee: Rolex S.A., Geneva (CH)

( * ) Notice: Subject to any disclaimer, the term of this patent is extended or adjusted under 35 U.S.C. 154(b) by 34 days.

(21) Appl. No.: 12/479,947

(22) Filed: Jun. 8, 2009

(65) Prior Publication Data

US 2009/0303842 A1 Dec. 10, 2009

(30) Foreign Application Priority Data

Jun. 10, 2008 (EP) ..... 08405153
Aug. 4, 2008 (EP) ..... 08405192

(51) Int. Cl.
*G04B 1/10* (2006.01)

(52) U.S. Cl. ..... 368/140; 368/203

(58) Field of Classification Search ..... 368/140, 368/203

See application file for complete search history.

(56) References Cited

U.S. PATENT DOCUMENTS

| | | | | |
|---|---|---|---|---|
| 3,187,416 | A | 6/1965 | Tuetey et al. | |
| 3,624,883 | A | 12/1971 | Baehni | |
| 5,301,742 | A * | 4/1994 | Sato et al. | 164/463 |
| 5,772,803 | A | 6/1998 | Perker et al. | |
| 6,371,195 | B1 * | 4/2002 | Onuki et al. | 164/113 |
| 6,427,753 | B1 * | 8/2002 | Inoue et al. | 164/80 |
| 6,603,236 | B2 * | 8/2003 | Nagasaka | 310/261.1 |
| 6,843,594 | B1 | 1/2005 | Moteki et al. | |
| 6,863,435 | B2 * | 3/2005 | Moteki et al. | 368/140 |
| 6,934,222 | B2 * | 8/2005 | Fujimori | 368/204 |
| 7,280,438 | B2 * | 10/2007 | Fujisawa | 368/47 |
| 2007/0133355 | A1 * | 6/2007 | Hara et al. | 368/140 |
| 2009/0194205 | A1 | 8/2009 | Loffler et al. | |
| 2011/0072873 | A1 * | 3/2011 | Gritti et al. | 72/66 |

FOREIGN PATENT DOCUMENTS

| | | | |
|---|---|---|---|
| DE | 3136303 | A1 | 4/1983 |
| EP | 0942337 | A1 | 9/1999 |
| EP | 1385179 | A1 | 1/2004 |
| FR | 1 533 876 | A | 7/1968 |
| WO | 2007/038882 | A1 | 4/2007 |
| WO | 2011/069273 | A1 | 6/2011 |

OTHER PUBLICATIONS

European Search Report of EP08405192, dated Mar. 12, 2009.

Kumar et al., Thermal embrittlement of Fe-based amorphous ribbons, J. Non-Crystalline Solids, 354, pp. 882-888 (2008).

Inoue et al., Preparation, mechanical strengths, and thermal stability of Ni-Si-B and Ni-P-B amorphous wires, Metallurgical Transactions, 18A, pp. 621-629 (1987).

Morris, Crystallization embrittlement of Ni-Si-B alloys, J. Materials Science, 20, pp. 331-340 (1985).

Favre, Various types of springs used in watchmaking, Bulletin SSC, 22, pp. 19-25 (1996), with partial English translation.

(Continued)

*Primary Examiner* — Sean Kayes

(74) *Attorney, Agent, or Firm* — Westerman, Hattori, Daniels & Adrian, LLP

(57) ABSTRACT

Mainspring for a mechanism driven by a motor spring, especially for a timepiece, formed from a ribbon of metallic glass material. This ribbon is monolithic and has a thickness of greater than 50 μm.

8 Claims, 1 Drawing Sheet

OTHER PUBLICATIONS

Pol'Dyaeva G. P. et al, "Elastic Characteristics and Microplastic Deformation of Iron-Base Amorphous Alloys", Metal Science and Heat Treatment USA, vol. 25, No. 9-10, Sep. 1983, pp. 653-654, XP002633344, ISSN: 0026-0673. Cited in co-pending U.S. Appl. No. 13/514,137.

Berner G. -A., "Dictionnaire Professionnel Illustré de l'Horlogerie", 1961, Chambre suisse de l'Horlogerie, La Chaux-de Fonds, XP002580071, pp. 780-781, paragraph [3484C]; Figure 3484C. Cited in co-pending U.S. Appl. No. 13/514,137.

Koba E. S. et al., "Effect of plastic deformation and high pressure working on the structure and microhardness of metallic glasses", Acta Metallurgica & Materialien, vol. 42, No. 4, Apr. 1, 1994, pp. 1383-1388. Cited in co-pending U.S. Appl. No. 13/514,137.

Lu J. et al, "Deformation behavior of the Zr41.2Ti13.8Cu12.5Ni10Be22.5 bulk metallic glass over a wide range of strain-rates and temperatures", Acta Materialia 51, pp. 3429-3443, 2003. Cited in co-pending U.S. Appl. No. 13/514,137.

Luborsky F. E. et al., "Potential of amorphous alloys for application in magnetic devices", J. Appl. Phys. vol. 49, No. 3, pp. 1769-1774 (Mar. 1978).

Osterstock F. et al., "Fracture of Metallic Glass Ribbons at Room and Low Temperatures as a Function of the Degree of Relaxation", International Journal of Rapid Solidification, vol. 3, pp. 295-317 (1987).

Liebermann, H.H. et al., "Rapidly Solidified Alloys", Marcel Dekker, Inc., New York, pp. 279-282, 397-402, 422-430 (1993).

Feodorov, V.A. et al., "Evolution of mechanical characteristics of metallic glass Co-Fe-Cr-Si at annealing", in Eight International Workshop on Nondestructive Testing and Computer Simulations in Science and Engineering, Proc. of SPIE vol. 5831, SPIE, Bellingham, WA, pp. 181-185 (2005).

"Alloy Information, NIVAFLEX(R) 45/5", Vacuumschmelze GmbH & Co, KG, Hanau, Germany, 2 pages (Jan. 2008).

* cited by examiner

MAINSPRING

BACKGROUND OF THE INVENTION

The present invention relates to a mainspring for a mechanism driven by a motor spring, especially for a timepiece, formed from a metallic glass material.

Description of the Prior Art

A watch that includes a motor spring made of amorphous metal has already been proposed in EP 0 942 337. In fact, only a strip, formed from a laminate comprising ribbons of amorphous metal with thicknesses ranging up to 50 μm assembled with epoxy resin, is described in the above document. As a variant, it has been proposed to assemble strips by spot welding the two ends and the point of inflection of the free shape of the spring.

The major problem of such a strip is the high risk of delaminating the laminate during its forming operation and following the repeated winding and unwinding operations to which such a spring is subjected. This risk is all the more acute when the resin ages badly and loses its properties.

This solution would guarantee the functionality and fatigue behavior of the spring. Furthermore, the proposed modeling of the theoretical shape of the spring does not take into account the behavior of a laminated material.

The reason for choosing to use several thin strips joined together is due to the difficulty of obtaining thicker metallic glass strips, although processes are known for manufacturing ribbons with a thickness ranging from around 10 to around 30 microns by rapid quenching, which processes were developed during the 1970's for amorphous ribbons used for their magnetic properties.

It is obvious that such a solution cannot meet the torque, reliability and lifetime requirements that a mainspring must satisfy.

As regards conventional springs made of the alloy Nivaflex® in particular, the initial alloy strip is formed into a mainspring in two steps:

- the strip is coiled up on itself so as to form a tight spiral (elastic deformation) and then treated in a furnace to set this shape. This heat treatment is also essential for the mechanical properties, as it enables the yield strength of the material to be increased by modifying its crystalline structure (precipitation hardening); and
- the spiral-shaped spring is wound up, therefore plastically deformed cold, so as to take up its definitive shape. This also increases the level of stress available.

The mechanical properties of the alloy and the final shape are the result of combining these two steps. A single heat treatment would not enable the desired mechanical properties to be achieved for the conventional alloys.

Fixing crystalline metal alloys involves a relatively lengthy heat treatment (lasting several hours) at quite a high temperature in order to modify the crystalline structure in the desired manner.

In the case of metallic glasses, the mechanical properties of the material are intrinsically tied to its amorphous structure and are obtained immediately after solidification, unlike the mechanical properties of conventional springs made of Nivaflex® alloy, which are obtained by a series of heat treatments at different stages in their manufacturing process. Consequently, and unlike the Nivaflex® alloy, subsequent hardening by heat treatment is unnecessary.

Conventionally, only the winding-up operation gives the spring the optimum shape, thereby providing the strip with the maximum stress over its entire length once the spring has been wound. In contrast, for a spring made of a metallic glass, the final optimum shape is fixed only by a single heat treatment, whereas the high mechanical properties are tied just to its amorphous structure. The mechanical properties of metallic glasses are not changed by the heat treatment or by the plastic deformation, since the mechanisms are completely different from those encountered in a crystalline material.

The object of the present invention is to remedy, at least in part, the abovementioned drawbacks.

SUMMARY OF THE INVENTION

For this purpose, the subject of the present invention is a mainspring for a mechanism driven by a motor spring especially for a timepiece, formed from a metallic glass ribbon, wherein said ribbon is monolithic and has a thickness greater than 50 μm.

By producing a mainspring from a monolithic ribbon of metallic glass it is possible to fully benefit from the advantages of this class of material, in particular its ability to store a high density of elastic energy and to restore it with a remarkably constant torque. The maximum stress and Young's modulus values of such materials enable the $\sigma^2/E$ ratio to be increased compared with conventional alloys, such as Nivaflex®.

BRIEF DESCRIPTION OF THE DRAWINGS

The appended drawings illustrate, schematically and by way of example, one embodiment of the mainspring according to the invention.

DESCRIPTION OF THE PREFERRED EMBODIMENT

Figure 1:
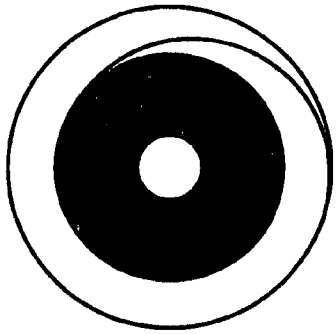
FIG. 1 is a plan view of the spring wound in the barrel.

In the example given below, the ribbons intended to form the mainsprings are produced by using the quench wheel technique (also called planar flow casting), which is a technique for producing metal ribbons by rapid cooling. A jet of molten metal is propelled onto a rapidly rotating cold wheel. The speed of the wheel, the width of the injection slot and the injection pressure are parameters that define the width and thickness of the ribbon produced. Other ribbon production techniques may also be used, such as for example twin-roll casting.

In the present example, the alloy $Ni_{53}Nb_{20}Zr_8Ti_{10}Co_6Cu_3$ is used. 10 to 20 g of alloy are placed in a delivery nozzle heated to between 1050 and 1150° C. The width of the nozzle slot is between 0.2 and 0.8 mm. The distance between the nozzle and the wheel is between 0.1 and 0.3 mm. The wheel onto which molten alloy is deposited is a wheel made of a copper alloy and is driven with a tangential velocity ranging from 5 to 20 m/s. The pressure exerted to expel the molten alloy through the nozzle is between 10 and 50 kPa.

Only a correct combination of these parameters enables ribbons with a thickness greater than 50 μm, typically between 50 and 150 μm, and with a length of more than one meter to be formed.

For a ribbon subjected to pure bending, the maximum elastic moment is given by the following equation:

$$M_{max} = \frac{e^2 h}{6}\sigma_{max} \quad (1)$$

in which:

e is the ribbon thickness [in mm];

h is the ribbon height [in mm]; and $\sigma_{max}$ is the maximum flexural stress [in N/mm$^2$].

Figure 2:
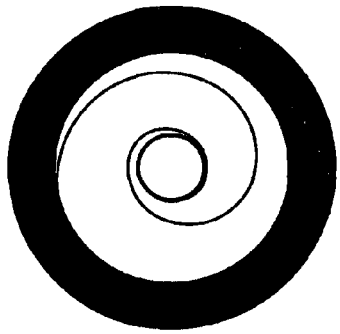
FIG. 2 is a plan view of the unwound spring in the barrel.
Figure 3:
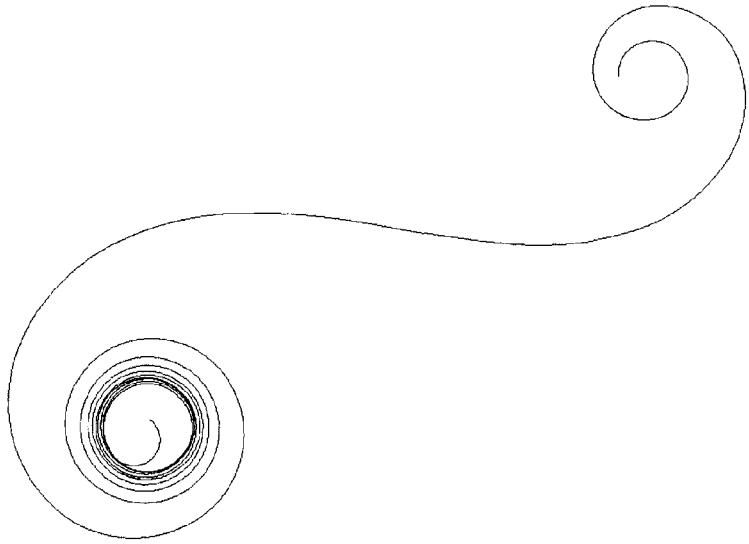
FIG. 3 is a plan view of the spring in its free state.

The mainspring releases its energy when it passes from the wound state to the unwound state. The object is to calculate the shape that the spring must have in its free state so that each portion is subjected to the maximum bending moment in its wound state. FIGS. 1 to 3 below describe the three configurations of the mainspring, namely the wound state, the unwound state and the free state.

For the calculations, the spring in its wound state (see FIG. 1) is considered to be an Archimedean spiral with the turns tight against one another.

In this case, any point on the curvilinear abscissa may be written as:

$$r_n = r_{core} + ne \quad (2)$$

in which:

$r_n$ is the radius of the nth turn in the wound state [in mm];

$r_{core}$ is the radius of the barrel core [in mm];

n is the number of winding turns;

e is the ribbon thickness [in mm].

In addition, the length of the curvilinear abscissa of each turn is given by:

$$L_n = r_n\theta \quad (3)$$

in which:

$L_n$ is the length of the curvilinear abscissa of the nth turn [in mm];

$r_n$ is the radius of the nth turn in the wound state [in mm]; and $\theta$ is the angle traveled (in radians]—in the case of one turn, $\theta=2\pi$.

The shape of the spring in its free state is calculated by taking into account the differences in radii of curvature so that the spring is stressed to $\sigma_{max}$ over the entire length, where:

$$\frac{1}{r_n} - \frac{1}{R^n_{free}} = \frac{M_{max}}{EI} = \frac{2\sigma_{max}}{eE} \quad (4)$$

in which:

$R_{free}{}^n$ is the radius of the nth turn in the free state [in mm];

$M_{max}$ is the maximum moment [in N.mm];

E is the Young's modulus [in N/mm$^2$]; and

I is the moment of inertia [in mm$^4$].

Therefore, to calculate the theoretical shape of the spring in the free state, all that we require is to calculate the following elements:

1. the radius of the nth turn in the wound state from equation (2), with n=1, 2, . . . ;
2. the length of the curvilinear abscissa of the nth turn from equation (3);
3. the radius in the free state of the nth turn from equation (4); and, finally
4. the angle of the segment of the nth turn from equation (3), but by replacing $r_n$ by $R_{free}{}^n$ and by maintaining the segment length $L_n$ calculated in step 2.

With these parameters, it is now possible to construct the spring in the free state so that each element of the spring is stressed to $\sigma_{max}$ (FIG. 3).

The metallic glass ribbon is obtained by rapidly solidifying the molten metal on a wheel made of copper or an alloy having a high thermal conductivity, rotating at high speed. A minimum critical cooling rate is required in order to vitrify the liquid metal. If the cooling is too slow, the metal solidifies by crystallizing and it loses its mechanical properties. It is important, for a given thickness, to ensure the maximum cooling rate. The higher this cooling rate, the less time the atoms will have to relax and the higher the free volume concentration will be. The ductility of the ribbon is therefore improved.

The plastic deformation of the metallic glasses, below a temperature of about $0.7\times T_g$ (the glass transition temperature) in K, takes place heterogeneously via the initiation and then the propagation of slip bands. The free volumes act as slip band nucleation sites and the more nucleation sites there are the less the deformation is localized and the greater the deformation before fracture becomes.

The planar flow casting step is therefore the key step for obtaining the mechanical and thermodynamic properties of the ribbon.

Between $T_g$-100 K and $T_g$, the viscosity decreases strongly with temperature, by about an order of magnitude when the temperature rises by 10 K. The viscosity at $T_g$ is generally equal to $10^{12}$ Pa·s, independently of the alloy in question. It is therefore possible to model the viscous body, in this case the ribbon, so as to give it its desired shape, and then to cool it so as to lastingly "freeze in" the shape.

Around $T_g$, the thermal activation allows the free volumes and atoms to diffuse within the material. The atoms locally form more dense domains, close to a crystalline structure, at the expense of the free volumes, which will be annihilated. This phenomenon is called relaxation. The reduction in free volume is accompanied by an increase in the Young's modulus and a reduction in subsequent ductility.

At higher temperatures (above $T_g$), the relaxation phenomenon may be likened to an annealing step. The diffusion of the atoms is facilitated by the thermal agitation: the relaxation is thus accelerated and results in a drastic embrittlement of the glass by free volume annihilation. If the treatment time is too long, the amorphous material will crystallize and thus lose its exceptional properties.

Hot forming therefore involves a balance between sufficient relaxation, in order to retain the free volume, and a small as possible reduction in ductility.

To achieve this, it is necessary to heat and cool as rapidly as possible and keep the ribbon at the desired temperature for a well-controlled time.

The $Ni_{53}Nb_{20}Zr_8Ti_{10}Co_6Cu_3$ alloy used was selected for its excellent compromise between tensile strength (3 GPa) and its vitrifiability (3 mm critical diameter and $\Delta T$ ($=T_g-T_x$) equal to 50° C., where $T_x$ denotes the crystallization temperature). Its elastic modulus is 130 GPa, measured in tension and bending.

Mechanical Properties:

Maximum resistance $\sigma_{max}$=3000 MPa

Elastic deformation $\epsilon_{max}$=0.02

Elastic modulus E=130 GPa

Thermodynamic Properties:

Glass transition temperature $T_g$=593° C.

Crystallization temperature $T_x$=624° C.

Melting point $T_m$=992° C.

The ribbons produced by the PFC (planar flow casting) technique had a width of several millimeters and a thickness greater than 50 μm, typically between 50 and 150 μm. According to one embodiment, ribbons were machined by WEDM (wire electrical discharge machining) with the typical width and length of a mainspring. The sides were ground, after which the operation of forming the spring was carried out, on the basis of the theoretical shape as calculated above. According to another embodiment, the ribbon produced had the desired width directly.

A fitting is used to carry out the forming operation, this fitting being of the type of those generally used for this purpose, onto which the spring is wound so as to give it its free shape, determined by the theoretical shape as calculated above, taking into account the variation between the shape imposed by the fitting and the free shape actually obtained. Specifically, it has been found that the curvatures (being defined as the inverse of the radius of curvature) of the spring in the free state after forming were reduced relative to the curvatures of the shape of the fitting. The curvatures of the fitting must therefore be increased in order for the free shape obtained to correspond to the theoretical shape. Furthermore, the expansion of the shape depends on the heating parameters, on the alloy and on its initial relaxation state, and is typically 25% under the conditions used below.

The spring in its fitting is then placed in a furnace heated to about $T_g$ (590° C.) for a time ranging from 3 to 5 minutes, depending on the fitting used.

Other heating methods may be used, such as Joule heating or the use of a jet of hot inert gas for example.

Riveted onto the external end of the spring, once it has been formed in this way, is a sliding flange for a self-winding watch spring made of Nivaflex® alloy, in order for winding/unwinding tests to be carried out. The sliding flange is necessary in order for such a spring to fulfill its function. However, the method of joining said flange to the strip and the material of the flange may vary.

Figure 4:
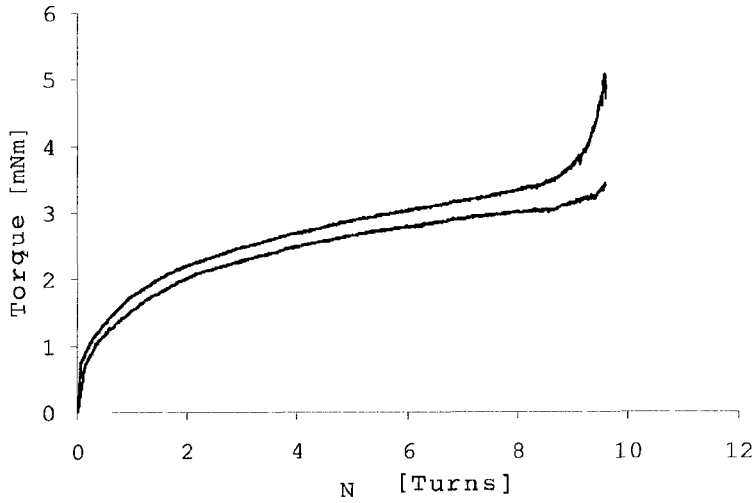
FIG. 4 is a winding/unwinding diagram for a mainspring made of metallic glass.

FIG. 4 shows the variation in torque as a function of the number of turns obtained with the calculated spring formed using the method described in the present document. This winding/unwinding curve is very characteristic of the behavior of a mainspring. In addition, the torque, the number of development turns and the overall efficiency, given the dimensions of the ribbon, are completely satisfactory.

The invention claimed is:

1. A mainspring for a mechanism driven by a motor spring, especially for a timepiece, wherein the mainspring is a single monolithic metallic glass ribbon having a thickness greater than 50 μm, wherein the monolithic metallic glass ribbon has a spiral-shaped curvature in a free state of the mainspring.

2. The mainspring as claimed in claim 1, the thickness of which is between 50 μm and 150 μm.

3. The mainspring as claimed in claim 1, the shape of which in the free state is defined by the radius of the nth turn in the wound state, corresponding to the equation $$r_n = r_{core} + ne$$

in which:

$r_n$ is the radius of the nth turn in the wound state [in mm];

$r_{core}$ is the radius of the barrel core [in mm];

n is the number of winding turns;

e is the ribbon thickness [in mm], by the length of the curvilinear abscissa of the nth turn, corresponding to the equation $$L_n = r_n \theta$$

in which:

$L_n$ is the length of the curvilinear abscissa of the nth turn [in mm];

$r_n$ is the radius of the nth turn in the wound state [in mm]; and

θ is the angle traveled (in radians), by the radius of the nth turn in the free state, corresponding to the equation $$\frac{1}{r_n} - \frac{1}{R_{free}^n} = \frac{M_{max}}{EI} = \frac{2\sigma_{max}}{eE}$$

in which:

$R_{free}^n$ is the radius of the nth turn in the free state [in mm];

$M_{max}$ is the maximum moment [in N.mm];

E is Young's modulus [in N/mm$^2$]; and

I is the moment of inertia [in mm$^4$], and by the angle of the segment of the nth turn, corresponding to the equation:

$$L_n = R_{free}^n \theta$$

so that the spring wound into an Archimedean spiral is stressed to the maximum bending stress $\sigma_{max}$ over its entire length.

4. The mainspring as claimed in claim 2, the shape of which in the free state is defined by the radius of the nth turn in the wound state, corresponding to the equation $$r_n = r_{core} + ne$$

in which:

$r_n$ is the radius of the nth turn in the wound state [in mm];

$r_{core}$ is the radius of the barrel core [in mm];

n is the number of winding turns;

e is the ribbon thickness [in mm], by the length of the curvilinear abscissa of the nth turn, corresponding to the equation $$L_n = r_n \theta$$

in which:

$L_n$ is the length of the curvilinear abscissa of the nth turn [in mm];

$r_n$ is the radius of the nth turn in the wound state [in mm]; and

θ is the angle traveled (in radians), by the radius of the nth turn in the free state, corresponding to the equation $$\frac{1}{r_n} - \frac{1}{R_{free}^n} = \frac{M_{max}}{EI} = \frac{2\sigma_{max}}{eE}$$

in which:

$R_{free}^n$ is the radius of the nth turn in the free state [in mm];

$M_{max}$ is the maximum moment [in N.mm];

E is Young's modulus [in N/mm$^2$]; and

I is the moment of inertia [in mm$^4$], and by the angle of the segment of the nth turn, corresponding to the equation:

$$L_n = R_{free}^n \theta$$

so that the spring wound into an Archimedean spiral is stressed to the maximum bending stress $\sigma_{max}$ over its entire length.

5. The mainspring as claimed in claim 1, wherein the metallic glass of the monolithic metallic glass ribbon has an amorphous structure resulting from heating the ribbon to about the glass transition temperature during forming.

6. The mainspring as claimed in claim 1, wherein the monolithic metallic glass ribbon has an S-shaped curvature in a free state of the mainspring.

7. The mainspring as claimed in claim 6, wherein the S-shaped curvature has a point of inflection in a proximity of an end of the monolithic metallic glass ribbon.

8. The mainspring as claimed in claim 1, wherein the monolithic metallic glass ribbon having the S-shaped curvature has substantially the same ductility as a monolithic metallic glass ribbon which is identical except having a planar shape instead of S-shaped curvature.

* * * * *